US007380303B2

(12) United States Patent
Bellinetto et al.

(10) Patent No.: US 7,380,303 B2
(45) Date of Patent: Jun. 3, 2008

(54) METHOD FOR CONTROLLING THE PROGRAM OF A WASHING MACHINE AND WASHING MACHINE USING SUCH METHOD

(75) Inventors: Enrico Bellinetto, Azzate (IT); Raffaele Paganini, Varese (IT); Rocco Petrigliano, Valsinni (IT)

(73) Assignee: Whirlpool Corporation, Benton Harbor, MI (US)

( * ) Notice: Subject to any disclaimer, the term of this patent is extended or adjusted under 35 U.S.C. 154(b) by 538 days.

(21) Appl. No.: 10/509,702

(22) PCT Filed: Mar. 20, 2003

(86) PCT No.: PCT/EP03/02930

§ 371 (c)(1),
(2), (4) Date: Sep. 30, 2004

(87) PCT Pub. No.: WO03/083200

PCT Pub. Date: Oct. 9, 2003

(65) Prior Publication Data

US 2005/0125909 A1 Jun. 16, 2005

(30) Foreign Application Priority Data

Apr. 2, 2002 (EP) ..... 02007275

(51) Int. Cl.
*D06F 35/00* (2006.01)

(52) U.S. Cl. ..... 8/158; 68/12.04; 68/12.21; 8/159

(58) Field of Classification Search ..... 8/158, 8/159; 68/12.04, 12.21
See application file for complete search history.

(56) References Cited

U.S. PATENT DOCUMENTS 5,493,877 A * 2/1996 Wickremasinghe ..... 68/208
5,671,494 A * 9/1997 Civanelli et al. ..... 8/159
5,768,729 A * 6/1998 Cracraft ..... 8/158
6,023,950 A * 2/2000 Battistella ..... 68/12.04

* cited by examiner

*Primary Examiner*—Michael Barr
*Assistant Examiner*—Jason Heckert
(74) *Attorney, Agent, or Firm*—Clifton Green; Michael D. Lafrenz

(57) ABSTRACT

A method for controlling the program of a washing machine comprises the recording of the amount of water supplied to the tub of the washing machine, the assessment of the amount of free water present in the tub (T), the evaluation of the amount of water absorbed by the load by subtracting the amount of free water from the amount of water supplied to the tub (T), the estimate of the specific absorption of the load based on the water absorbed and on free water, and the calculation of a load equivalent based on the specific absorption and on the amount of water absorbed by the load, such load equivalent being related to the load in the machine and being used for controlling the program thereof.

11 Claims, 7 Drawing Sheets

Figure 1:
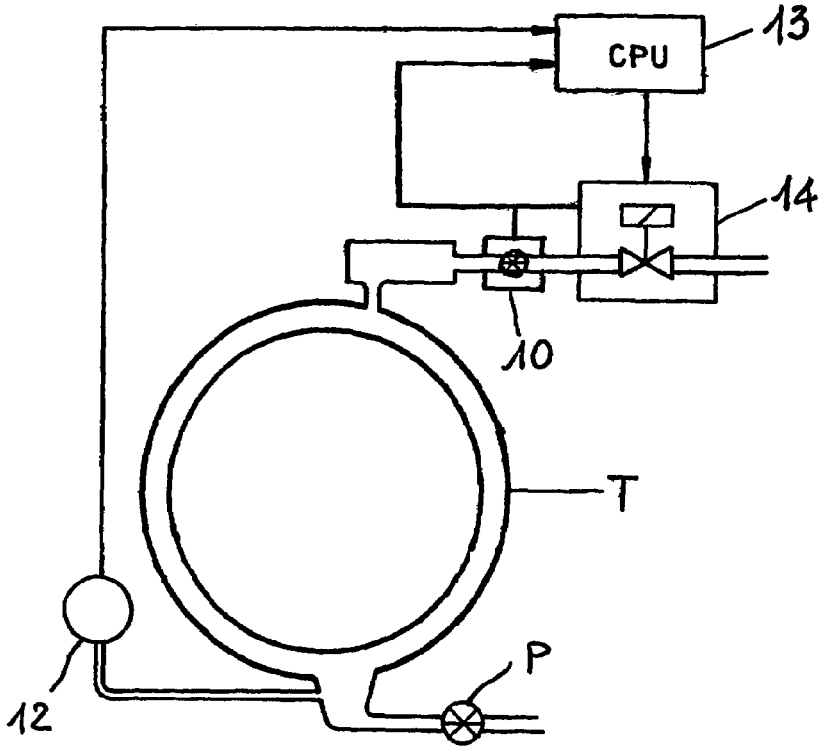

METHOD FOR CONTROLLING THE PROGRAM OF A WASHING MACHINE AND WASHING MACHINE USING SUCH METHOD

The present invention relates to a method of controlling the program of a washing machine comprising the recording of the quantity of water supplied to the tub of the washing machine.

Such a method is disclosed in GB 2070648, which is based on the knowledge that in a water level controlled program cycle of a washing machine the quantity of water supplied constitutes a measure of the absorbability of the washing and, with the same type of washing, is also a measure for the weight of the washing. Such known method cannot give optimal results since the number of refilling operations for keeping the water level around a nominal level of water in the tub makes such method very time consuming.

The method according to the present invention does overcome the above technical problems and guarantees a minimum performance water level and safety control. According to such new method, the load detection and the time in which water (according to the detected load) is fed in the drum is very quick if compared to the known methods.

The features reported in the appended claims characterize the method according to the invention. Preferably the method makes use of a continuous water pressure sensor that enables a better control of overflow and leakage, thanks to the continuous level monitoring and "trend" analysis in addition to the level measurement. Moreover such kind of sensor allows a better foam detection, improves spinning_ performances by avoiding water ring formation and detects foam before and during the distribution.

The main idea underlying the present invention for estimating the load quantity is to monitor the water difference between the filled water and the "free water" in order to obtain the water that is absorbed by the load. With the term "free water" we mean the amount of water which is not absorbed by the laundry and which is contained in the washer tub. From the absorbed water the laundry load can be estimated. The assessment of free water is not used by known methods, since they are all focused only on the amount of water supplied to the tub for keeping water level around a nominal value. With these known methods it is not necessary to use a continuous water level sensor. If we call "absorbed water" the water quantity located within the load, and assuming that the free water can be determined by measuring the water level by a pressure sensor, the following mathematical relation deduces the absorbed water:

$$\text{Absorbed Water } (A_w) = \text{Filled Water} - \text{Free Water}$$

Even if this equation is not completely true because in a small part of the drum, in which the load is immersed in the water, there is interaction between the absorbed water and the free water, the equation is respecting the physics with a good approximation. With reference to $A_w$ two concepts are well known: the higher is the load quantity the higher is the water absorbed, and cotton load absorbs more water than synthetics and less water than terry towel. Therefore it is evident that the methodology of estimating the load quantity via the absorption is heavily affected by the textile, i.e. 7 liters can be absorbed by 3 kg of standard IEC (International Electrotechnical Commission) cotton or by 5 kg of synthetics or by 1.75 kg of terry towel. As the textile identification technology is not yet a real need and would render too complex the control program, the method according to the present invention puts water absorption into relationship with the standard IEC cotton and the estimated load quantity as "cotton equivalent" load. Once the $A_w$ is computed, the load quantity, cotton equivalent, can be estimated via the following relation:

$$A_w = \text{Load Equivalent} * K$$

$$\text{Load Equivalent } A_w * 1/K$$

Where K [Liters/Kg] identifies a particular condition of the load with reference to the set contour conditions. This parameter is called "specific absorption" SA and it is a characteristic of every specific laundry load. The correlation which links free water to water level in the tub is determined experimentally by introducing a known increasing water quantity in the empty tub of a washing machine, with drum motor off, and recording the correspondent water level that is measured by the continuous water level pressure sensor (CWL). Doing that, the characteristic liters added vs. water level (including mechanics geometry, air trap, sensor) is obtained. The equation that establishes the relation between the water level detected by the sensor [mm] and the free water volume in the tub may be determined by known interpolation techniques starting from the experimental curve, mainly in order to save computation time.

In case of no load, this equation provides the total amount of filled water: "liter in". In case of presence of laundry inside the drum, the difference:

$$\text{liter in} - \text{free water} = A_w$$

provides the water quantity absorbed by the load itself.

In order to get information on the above-mentioned specific absorption (SA), the applicant has carried out tests done with a fixed amount of laundry and different water amounts. The water level value has been considered after a certain time of agitation, and the water absorbed has been computed by using the mentioned method. By dividing the water absorbed by the load quantity, the specific absorption SA (water absorbed/kg load) has been determined.

Thanks to the above tests, the applicant discovered that in the range of the water used, the higher is the water amount supplied to the tub, the higher is the absorbed water and the free water. In other words, the applicant discovered that the specific absorption SA is water fill dependent or, in another way, the specific absorption SA is free water dependent. This fact has important consequences in terms of finding the best way for controlling the program of a washing machine. With a fixed amount of laundry, the applicant has prepared a diagram (and related computerized algorithm) that links the specific absorption SA to the water supplied to the tub and to the free water.

The applicant has also discovered that the specific absorption SA is load dependent, i.e. the absorbency of 7 kg load is different from the absorbency of 1 kg load. The main cause for this fact is the dependency on the volume ratio VR, where VR=Load Occupied Volume/Total Drum Volume: the higher is the VR the lower the $A_w$ (and SA consequently). In first approximation specific absorption SA has to be linked to the absorbed water $A_w$. According to the average values of tests carried out by the applicant with a commercial washing machine, the SA is 2.0 (7 kg load) in correspondence of 14 liters absorbed obtained by filling a total water amount of 19 liters. The SA becomes 2.75 in case of 1 kg load that absorbs 2 liters vs. 7 liters filled in the machine. A simple line can been drawn between these two points for inter-medium loads (see attached FIG. 2). This "curve" can be also a straight line (as in FIG. 2), and this depends mainly on the volume of the drum and of the pressure sensor position.

As the absorbed water is still a function of the total amount of water supplied to the tub and of the water level, the specific absorption SA can be represented in a 3D format, easily transformed in electronic form. The chart shown in FIG. 3 is the cotton characteristic absorption for the specific washing machine used in the tests.

Figure 2:
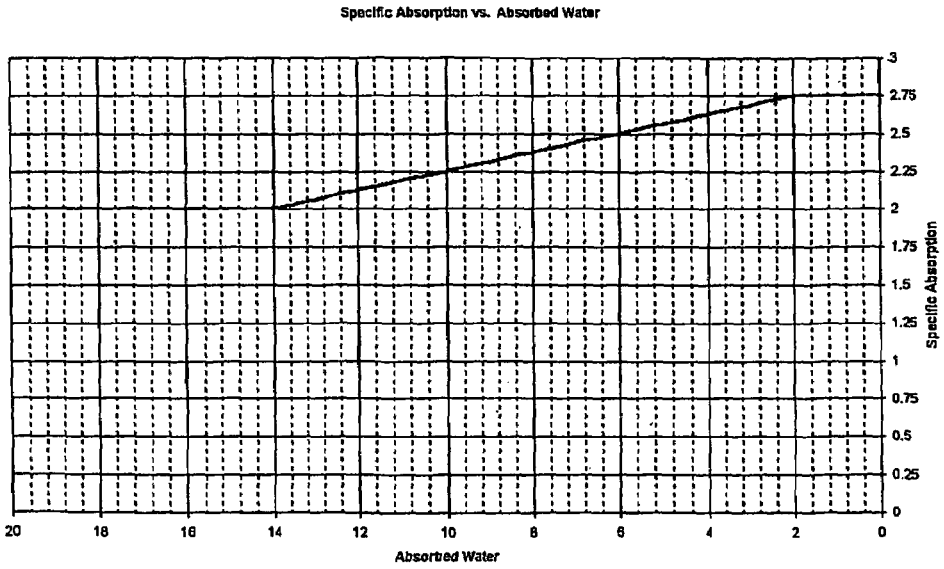
Figure 3:
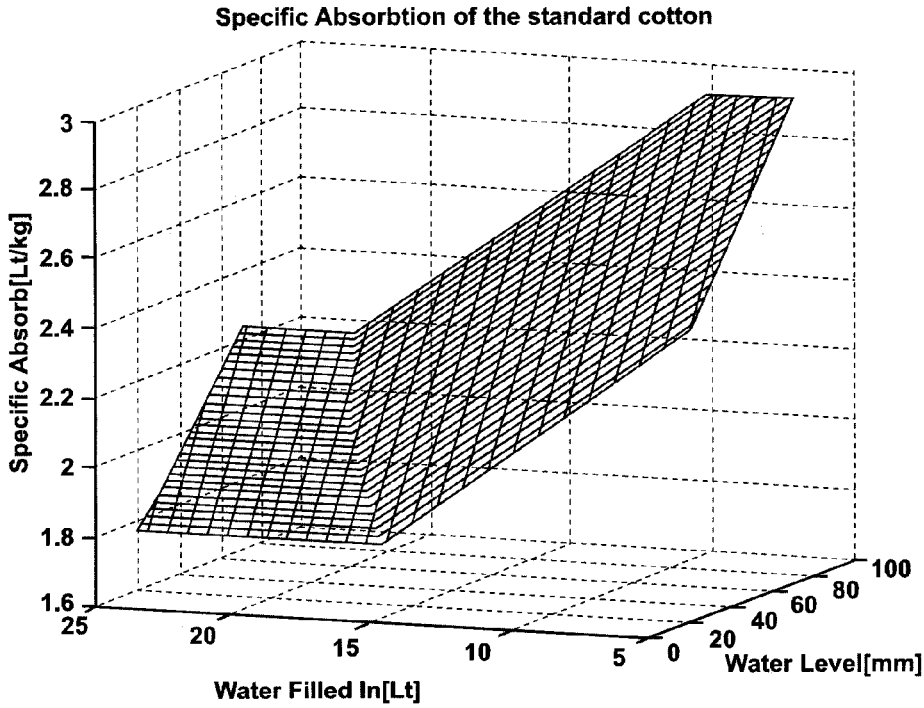
Figure 4:
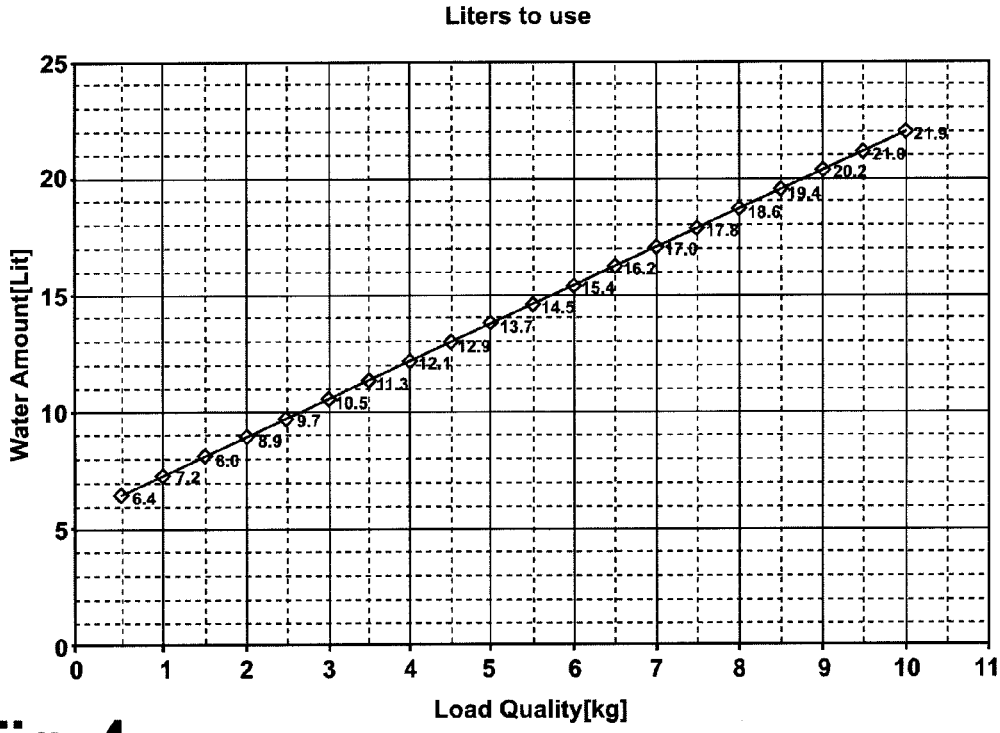
Figure 5:
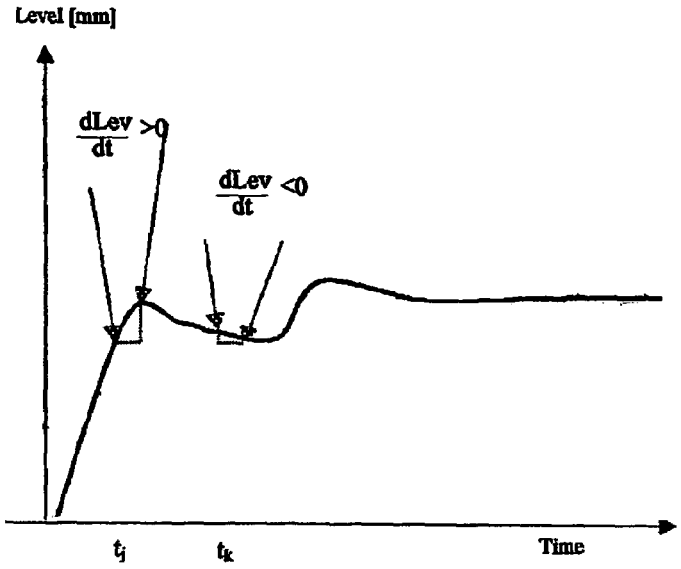
Figure 6:
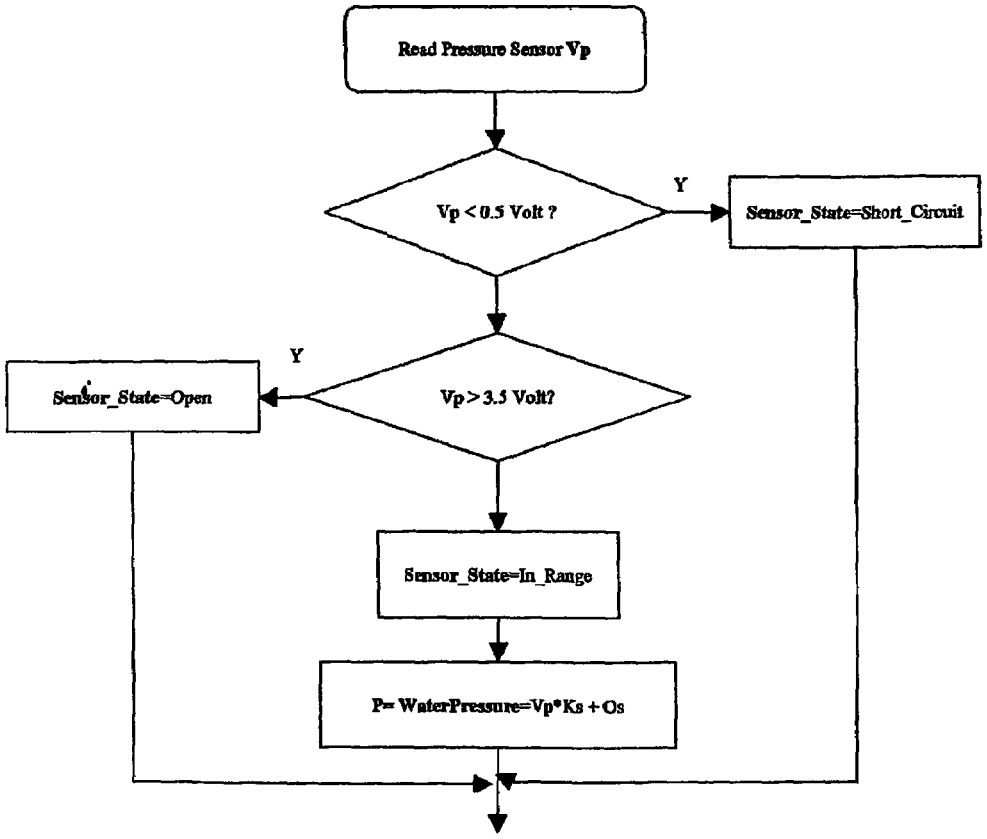
Figure 7:
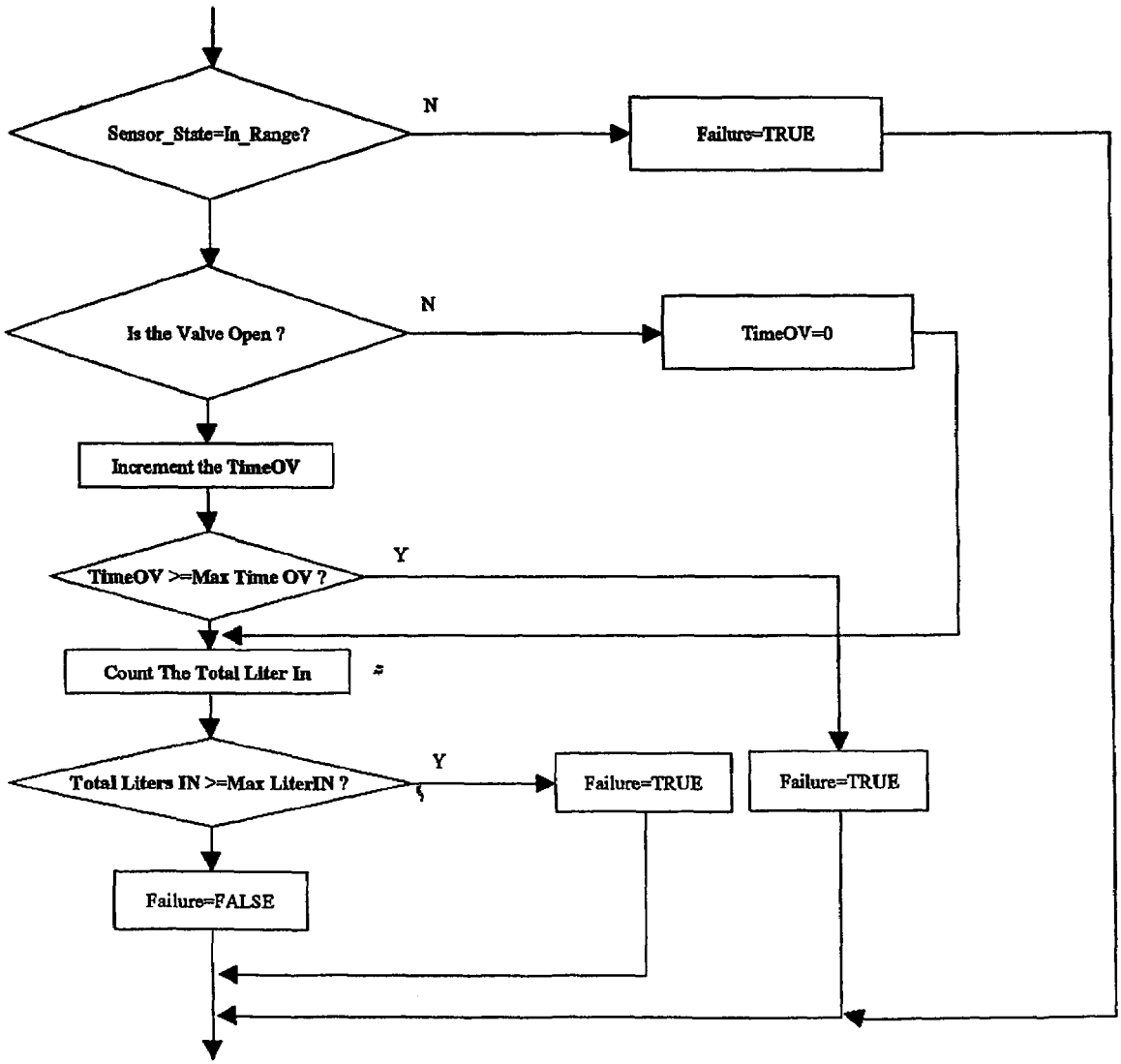
Figure 8:
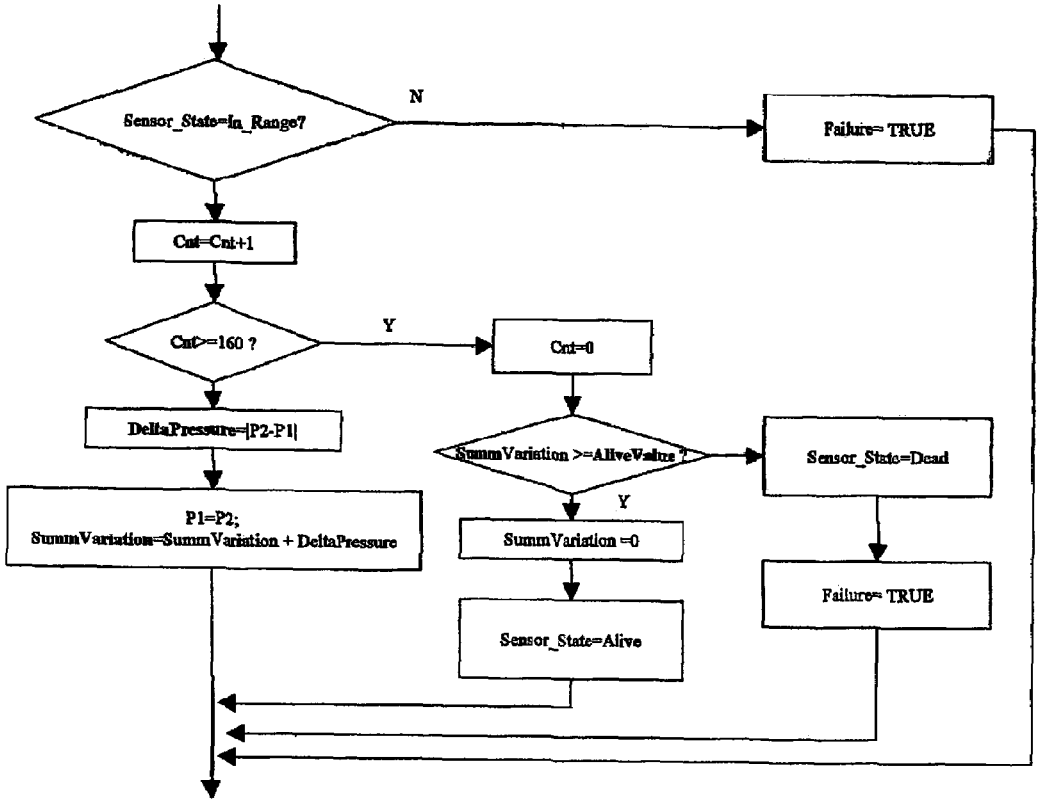
Figure 9:
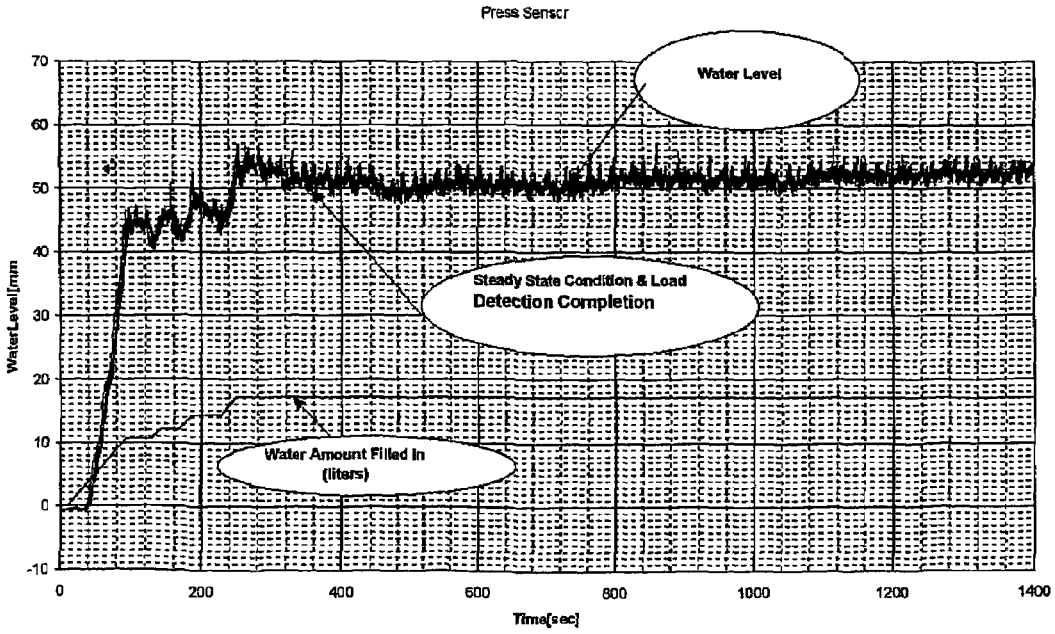
Figure 10:
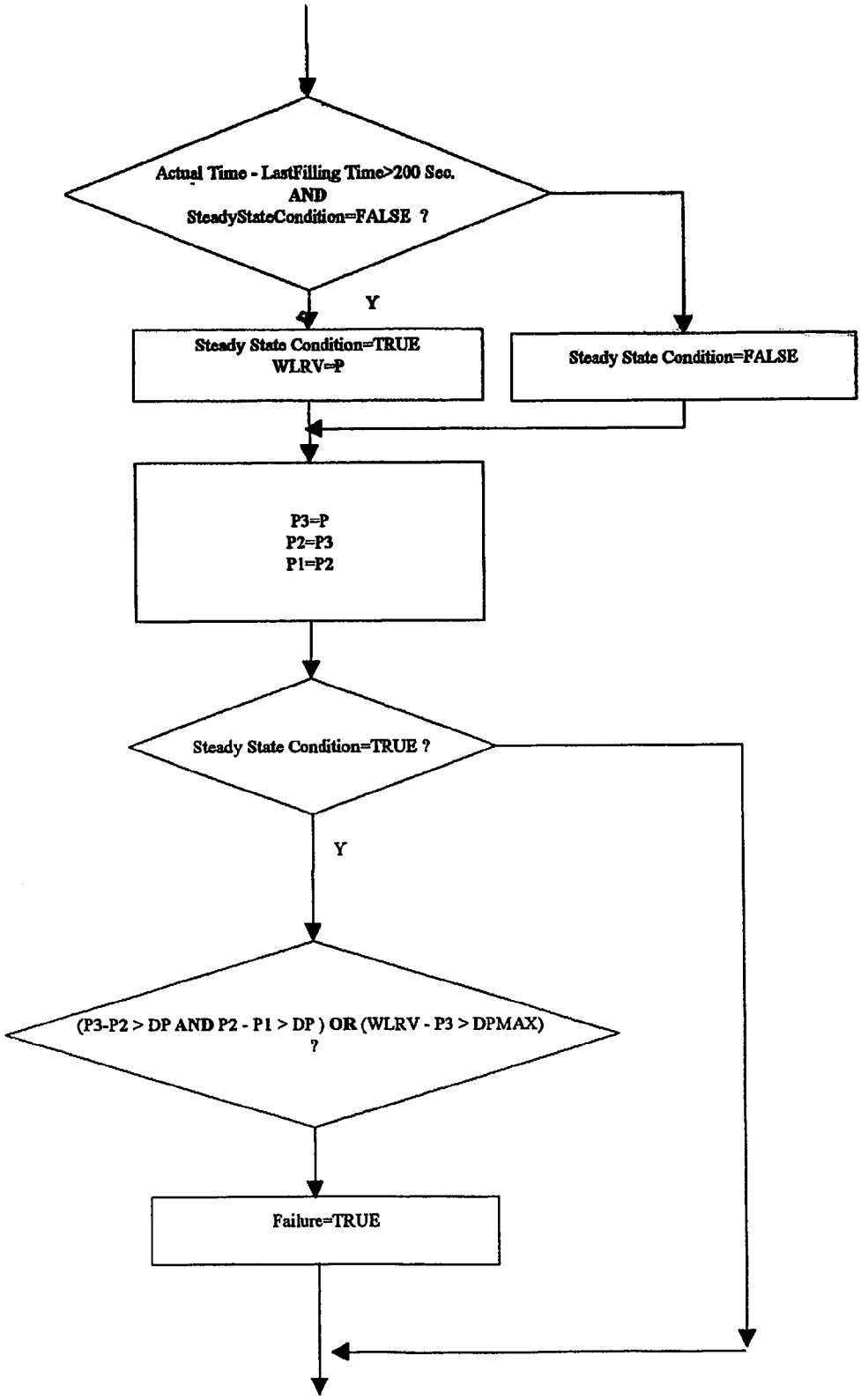
Figure 11:
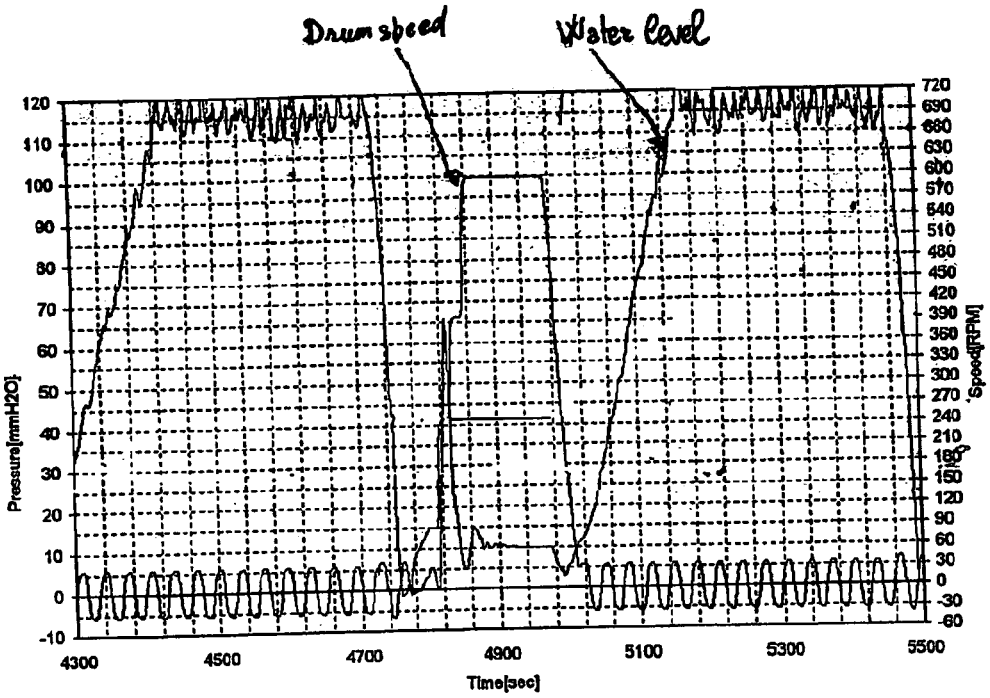
Figure 12:
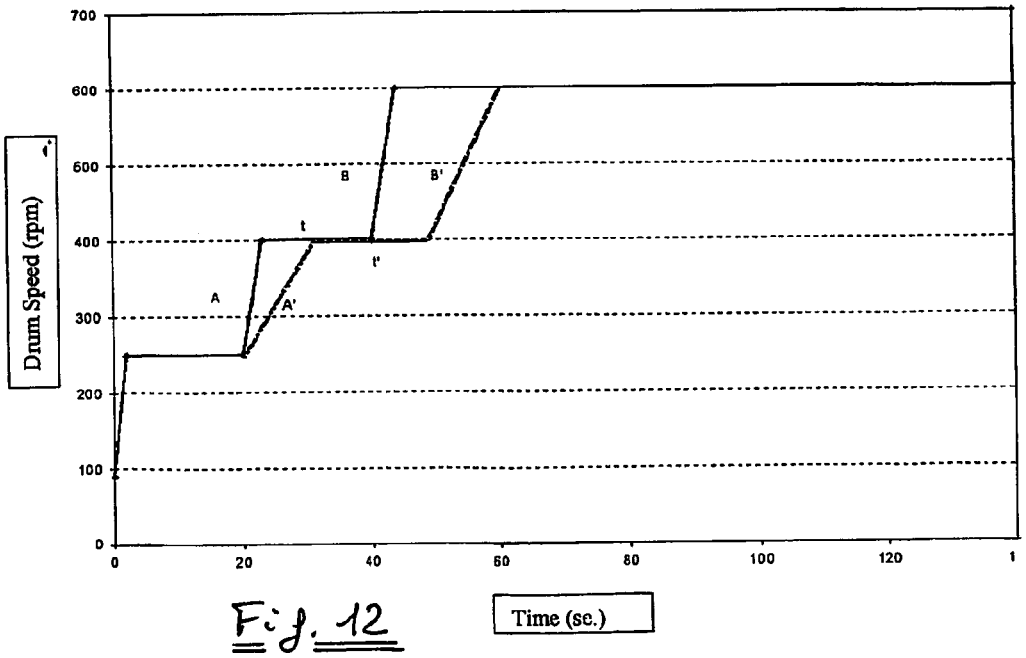

The present invention will be described further, by way of example, with reference to the load sensor algorithm used for controlling the washing machine and with reference, to the attached drawings, in which:

FIG. 1 is a simplified view of a drum washing machine according to the invention, FIG. 2 is a diagram showing the specific absorption vs. absorbed water, such diagram being used in the method according to the invention, FIG. 3 is a 3D diagram showing the cotton characteristic absorption for the specific washing machine used by the applicant in the experimental tests, FIG. 4 is a chart showing the liters of water to be used for load "equivalents", FIG. 5 is a diagram showing how the water level in the drum changes with time, FIG. 6 is a block diagram showing how the machine according to the invention can check a pressure sensor failure, FIG. 7 is a block diagram showing how the method according to the invention can check the total water amount loaded in the tub, FIG. 8 is a block diagram showing how the method according to the invention can check whether the pressure sensor is working properly, FIG. 9 shows a diagram of water level and total water vs. time, such diagram being used for detecting a possible water leakage, FIG. 10 is a flowchart showing how the determination of a "steady state" is carried out with the purpose of detecting a water leakage, FIG. 11 is a diagram showing the pressure measured by the pressure sensor and drum speed vs. time, and FIG. 12 is a diagram showing how the drum speed is changed by the control from the default A, t, B curve to the A', t', B' due a certain amount of detected water.

In a washing machine according to the invention, a flow meter 10 in the water supply line and a continuous water level sensor 12 are used, so that two pieces of information can be directly measured and one can be deduced, i.e.:

total supplied water [liters]

water amount in the tub "free water"[from mm to liters experimental curve]

water amount in the toad ("absorbed water") as the difference between total supplied water and free water.

Both flow meter 10 and level sensor 12 are connected to a central processor unit 13 of the program control system. The "absorbed water" depends on the load quantity and the specific absorption SA.

The specific absorption is a function of the total amount of water supplied to the tub and the free water.

Load Equivalent=(Tot Liters-Free Water)/Specific Absorption

Free Water=*f*(Water Level)

Specific Absorption=*f*(Tot Liters, Water Level)

The load quantity can be computed starting from values measured by the flow meter 10 (water supplied to the tub) and from the continuous water level sensor 12. From such value and from the experimental curve/equation that links the water level with the free water, it is possible to determine this latter. From the values of total amount of supplied water and from free water it is determined the absorbed water. From the diagram/equation of FIG. 2, a first value of specific absorption SA* is determined, based on the absorbed water. Then, from diagram/correlation of FIG. 3, a second value of specific absorption SA is determined, i.e. the specific absorption of the standard cotton for a specific washing machine. This value is a function of SA*, the total amount of water supplied to the tub, and the water level in the tub. At the end the cotton load equivalent is determined as ratio between water absorbed and specific absorption SA.

The above algorithm is applied continuously in the main loop software control of the washing machine. The main benefit of such continuous implementation is that when the load information is obtained, one can also set the desired water quantity to use. In order to know the correct water quantity to be used for an estimated load equivalent, the applicant has designed a chart (FIG. 4) showing the liters to be used for load equivalents. Obviously also this chart as all the other mentioned in this description can be "translated" in electronic format and embedded in the software controlling the program of the washing machine. Once the load quantity is estimated, the water quantity to be filled can be controlled according to the above "Liter to use" chart.

An inlet water valve 14 has to be controlled for satisfying the water needs. In order to speed up the control of the water absorption of the load, i.e. the preliminary phase in which the water: is supplied to the tub T and during which both the water supplied and the water level are monitored in order to get an estimate of laundry load, it is preferred to calculate the derivative of the water level in order to predict the future water level, i.e. without waiting for an actual reaching of such level. This preferred method consists of computing the load quantity on the basis of a water level prediction. This embodiment is schematically shown in FIG. 5.

In such figure, the water level behavior is represented. During a filling phase, at $t_j$ instant, the derivative function provides an estimation of the level at the next interval time. If this value is known in advance, one can decide to stop the water filling due to extra water consumption estimation. During the next period the water starts to be absorbed by the load and the water level decreases. In this phase the derivative function, computed at the $t_k$ time, might force the load detection algorithm to estimate a bigger load. If so, an additional re-filling will be enabled and the water is provided in advance compared to the usual control. This embodiment of the control method according to the invention, is based on the following equations:

$$PredictiveLevel = WaterLevel + K_p * \frac{\partial WaterLevel}{\partial t}$$

$$FreeWater = f(PredictiveLevel)$$

$$SpecificAbsorption = f(TotalLiters, PredictiveLevel)$$

$$LoadEquivalent = \frac{TotalLiters - FreeWater}{SpecificAbsorption}$$

Where, according to experimental tests:

Kp=1 if derivative is <−1.5 mm/32 sec. (used to accelerate filling)

Kp=0.25 if derivative is >0.25 mm/32 sec. (used to avoid overshoot) and 32" is the derivative time.

The test carried out by the applicant with a method according to the invention have shown a very good correlation between the actual laundry load and the actual total amount of water supplied to the tub T as a preferred value for such laundry load.

The total filling completion time varies, for the 7 kg load, from 250 sec to 450 seconds. The final load quantity parameter, used for controlling the program i.e. rhythm, washing speed, washing duration, unbalance detection, inertia detection, rinse number, water to be use in rinses, spinning speed, ect. has been detected after a reasonable time in which the water level is almost steady. According to a further feature of the present invention, it is provided a method for checking a possible failure of the pressure sensor by means of a check of the pressure value. In case the pressure information is not in the predetermined range, established by the sensor supplier, a failure message is provided to the central processor unit 13 of the washing machine. FIG. 6 represents an example of the pressure sensor failure check. The expected rage value of the sensor, that provides a voltage output Vp signal, is for instance from 0.5 Volt to 3.5 Volt. In case the sampled value is above 3.5V, it is expected to have the sensor "open", in case it is below 0.5V, "short circuit" condition is expected. It will be "in range" if none of the said conditions are detected. "Sensor State" represents a variable to which the sensor condition is assigned. The "P=Water Pressure" variable is obtained by converting the signal read by the pressure sensor (in this example voltage) in pressure, indicating the millimeter of water column. Ks and Os represent the Gain and the Offset values given by the sensor supplier.

Once the signal, coming from the pressure sensor, is considered to be in the admissible range, an additional check, regarding the total filled water amount, is here proposed. The main purpose of the present safety control, shown in FIG. 7, is to switch off the valve and stop the water flowing in case an abnormal water quantity is filled in or in case the valve is opened for a long time. The detected failure will then be processed up to inform the user that a water leakage has occurred or the valve is blocked in its open condition.

In the block diagram a check of the valve state is carried out: open or close is done. In case the valve is open, a variable "TimeOV" is incremented so that its value indicates the incremental valve opening time. MaxTimeOV represents a time limit, determined by the control design; in case TimeOV exceeds the time limit, a failure indication will be generated. TimeOV is set to zero in case the valve is close meaning that the load detection algorithm has established that the right filled water quantity is provided to the estimated load quantity. In the block diagram the check of the total water filled in is also included. The total amount of water filled: "Liter IN", dt provided by the flow meter, is always processed in the case where it exceeds a predetermined value MaxLiterIN, a failure indication will be generated.

Another safety control system according to the invention has the purpose of evaluating whether the pressure sensor is working properly, i.e. if the sensor is "alive" or "dead". It may happen that the sensor is blocked to a fixed and "in range" value. The way to distinguish the two conditions is to evaluate the acquired measures, done for a certain period, and verify if pressure variations are detected while the tumbling occurs.

The block diagram of FIG. 8 shows that every time the control is executed, a counter is incrementing its value in case the Sensor State is "in Range". Every certain number of pressure sensor readings, in the example 160, the evaluation of the acquired data is done. The "Sum Variation" variable includes the sum of 160 values; each value represents the "Delta Pressure" value (difference between actual P2=P and previous P1 measure, positive and negative variations are considered all positives). It is in fact expected that during the washing or rinsing phases, in which the drum is tumbling, the water level varies due to the elevators and the load movement. This small variation is accumulated (i.e. 160 values) to have this data more consistent. The "Sum Variation" is then processed and compared to a predetermined value "AliveValue". In case "Sum Variation" is considered too small, a failure of the pressure sensor is detected and an alarm signal is provided to the user.

In case of water leakage the control has to alert the user and/or suddenly pump out the water to prevent home flooding. A water leakage detection control according to the invention is here disclosed and it is based on a comparison between water levels acquired in different times.

The chart of FIG. 9 shows an example of water pressure behavior and its filtering signal during a washing cycle. In the first phase there are water fills according to the load detection algorithm. The total water filled is also plotted. The filling is concluded after a certain time (about 250 seconds) and small load absorption is then observed by the decreasing of the water level. We can consider a stable condition after a reasonable time i.e. 100-200 seconds starting from the last filling completion. The measured Water level in steady state condition is so red in memory as a reference value: WLRV.

With the purpose of veil cases of water leakage, periodically water trends evaluation and comparison values between the actual water level and the WLRV are computed.

In the flow chart of FIG. 10 the determination of the Steady State condition is done by comparing the execution of the last refilling time with the washing/rinsing execution time. If for instance 200 seconds are elapsed, the steady state condition is set to TRUE. The Actual pressure level P is then assigned to the WLRV variable and three pressure values measure at different times: present (P3=P), past P2 and P1 are updated. Water Leakage condition is then detected if abnormal water absorption is detected (WLRV>DPMAX), where DPMAX is considered as maximum water pressure change, or when the water slope DP is considered to be abnormal during the washing/rinsing phases. The water slope detection is a very important feature enabling the detection of small water leakage that are in general very difficult to monitor. The consumer benefit of the proposed control, compared to the ones provided by traditional mechanical pressure switches, is that a failure is detected before the minimum level (i.e. 20 mm) is reached. As a consequence less water will be flooded.

According to a further feature of the present invention, a new method is disclosed for reducing the system tolerances due to pressure sensor, tub tilting (in case of washing machine with tilted drum) and unlevelled floor. The "level calibration function" can be activated by the user or by service during the installation of the washing machine, by pushing a special button or buttons combination. The calibration consists, with motor OFF, in filling a known water amount (i.e. 3.5 liters), measuring the corresponding water level (P_nw) and saving in EEPROM the (P_offset): difference between (P_ref) and the (P_nw):

P_offset=P_ref·P_nw

The obtained offset value will be used to compensate the level measure for the free water amount determination. P_ref is a specific parameter of the free water curve, detected and stored as a default value, obtained in ideal condition when the reference water amount (i.e. 3.5 liters) is filled in.

According to a further feature of the invention, a control is used which is particularly useful for washing machine having big load capacity. In the very early spinning phase, even if the drain function is activated, the pump P (FIG. 1) might be unable to drain in time the water extracted by the wet load. Without a special water level control, it might be possible to start spinning with a consistent water quantity inside the drum. The primary effect is that the remaining water can not be expelled and will turn with the same speed of the drum (water ring effect). A second effect is the increase of the motor friction due to the water ring effect and, in certain cases, especially for the first two spinnings in which the amount of detergent is still high, the friction might be so high to block the motor.

The present control system has the objective to monitor the water quantity during all the spinning cycle and adapt the spinning profile accordingly.

The referred FIG. 11 shows a case in which a spinning speed is performed between two rinses with a moderate load quantity. At the end of the first rinse, the pump is activated and the water level is decreasing very fast. Generally the pumping is activated during all the spinning phase. After the distribution phase the spinning starts and a big amount of water is extracted from the load. As it is visible, a certain amount of water is still present while the spinning is in progress. After a certain time the water extraction can be considered concluded but, in the drum, some water is still present because was not pumped out. The water level, indicated in the chart, has to be considered as the sum of two pressure effects: pressure due to the actual water inside plus the pressure produced by the fast rotation of the drum and the consequence formation of wind on the drum wall. The estimation of the pressure due to the "wind" effect has to be carefully determinate to avoid wrong control decision. In case of big load quantity the amount of water extracted during the distribution phase and in the first spinning phase will be higher while the extracted water has a limited flow (unless more expensive pump is used). The consequence risk of spinning with high water quantity will be very high. The control proposal according to the present invention is so based on managing the spinning speed profile based on the water level. FIG. 12 describes the possible solution of the control algorithm that modify the theoretical spinning profile A slope, t plateau time and B slope according to the water pressure detected during each phase. The A' slope is performed in case higher water level is detected, t' is a longer waiting time allowing a longer water extraction from the drum, B' is also shown with an lower slope as an example of multiple areas in which the spinning vs. water level can be applied. The slopes and pause time are clearly dependent from the detected water level and in general the higher is the water level the lower will be the speed slope and the higher will be the pause time.

The invention claimed is:

1. A method for controlling the program of a washing machine comprising the following steps:

recording an amount of water supplied to a wash tub of the washing machine;

determining an amount of free water present in the tub;

determining an amount of water absorbed by the load by subtracting the amount of free water from the amount of water supplied to the tub;

estimating a specific absorption of the load based on the water absorbed and on the free water, calculating a load equivalent weight based on the specific absorption and on the amount of water absorbed by the load, the load equivalent weight being related to the load in the machine and being used for controlling the program thereof.

2. The method according to claim 1, further comprising the steps of:

determining the difference of water levels in predetermined time intervals, predicting future levels of water based on the determined differences, the future levels being directly related to a predicted amount of free water;

estimating a predicted specific water absorption based on the predicted amount of free water;

calculating a predicted load equivalent weight based on the predicted future water level and said predicted specific water absorption, and supplying an amount of water to the tub based on the predicted load equivalent weight.

3. The method according to claim 1, further comprising the step of checking if the total amount of water supplied to the tub is higher than a predetermined value, and the step of alerting a user accordingly.

4. The method according to claim 1, further comprising the steps of:

filling a known water amount to the tub, measuring a corresponding water level, storing a difference value between a pressure reference value and the above measured value, and using the stored value for compensating the measure of the free water amount.

5. The method according to claim 1 wherein an increase in speed vs. time for reaching a final spinning speed is selected according to the water level measured, the increase being lower when such water level is high.

6. The method according to claim 5, wherein the final spinning speed is reached in two or more steps, and the time interval between said steps is determined according to the measured water level, the time intervals being higher when the water level is high.

7. A washing machine, configured to determine an amount of water supplied to the machine, the washing machine comprising a central processor unit and a continuous water level sensor connected to the central processor unit, this latter being adapted to determine an amount of water absorbed by a load by subtracting the amount of free water from the amount of water supplied to the tub, to estimate a specific absorption of the load based on the water absorbed and on the free water, and to calculate a load equivalent weight based on the specific absorption and on the amount of water absorbed by the load, the load equivalent weight being related to the load in the machine.

8. The washing machine according to claim 7 wherein the central processor unit is further capable of determining a difference of water levels in predetermined time intervals, predicting future levels of water based on the above determined differences, such future levels being directly related to a predicted amount of free water, estimating a predicted specific absorption based on the predicted amount of free water, calculating a predicted load equivalent weight based on the predicted future water level and said predicted specific water absorption, and supplying an amount of water to the tub based on the predicted load equivalent weight.

9. The washing machine according to claim 7, wherein the central processor unit is provided with an alarm system that informs a user when the pressure valve measured by the continuous water level sensor is not within a predetermined range of values.

10. The washing machine according to claim 7, wherein the central processor unit is able to sum a predetermined number of consecutive pressure difference values measured by the continuous water level sensor, an alarm information being provided when such sum is below a predetermined value.

11. The washing machine according to claim 7, wherein the central processor unit comprises an alarm system for detecting the trend of water level in the tub during washing and/or rinsing, the alarm system alerting a user when the decrease of water level vs. time is higher than a predetermined value, this condition being indicative of a water leakage.

* * * * *